United States Patent [19]

Graham et al.

[11] Patent Number: 4,836,066

[45] Date of Patent: Jun. 6, 1989

[54] SELF-STORING TOOL SET

[75] Inventors: Charles H. Graham, Lava Hot Springs, Id.; George A. Matthews, Salt Lake City, Utah

[73] Assignee: GLI Industries, Inc., Salt Lake City, Utah

[21] Appl. No.: 936,457

[22] Filed: Dec. 1, 1986

[51] Int. Cl.[4] ..... B25B 13/00

[52] U.S. Cl. ..... 81/177.4; 81/440; 7/100

[58] Field of Search ..... 81/177.4, 177.6, 439, 81/440, 490; 7/100, 106, 138, 165, 167

[56] References Cited

U.S. PATENT DOCUMENTS

| | | | |
|---|---|---|---|
| 655,007 | 7/1900 | Rairigh | 81/440 X |
| 1,036,664 | 8/1912 | Marble | 81/440 X |
| 1,415,826 | 5/1922 | Finkhousen | 7/165 X |
| 2,173,042 | 9/1939 | Picard | 81/440 |
| 2,466,884 | 4/1949 | English et al. | 81/125.1 |
| 2,662,568 | 12/1953 | Lavietes | 81/440 |
| 4,269,311 | 5/1981 | Rich | 81/177.6 X |
| 4,699,030 | 10/1987 | Yang | 81/440 |

FOREIGN PATENT DOCUMENTS

| | | | |
|---|---|---|---|
| 856223 | 12/1960 | United Kingdom | 81/440 |

*Primary Examiner*—James G. Smith
*Attorney, Agent, or Firm*—Trask, Britt & Rossa

[57] ABSTRACT

A multiple-tool device has a multiplicity of tools pivotally connected to a tray, the tools having a use and a storage position with respect to the tray. A cover is connected to the tray, the cover having an open and a closed position. In the open position, tools may be rotated between use and storage position; in the closed position, tools are secured in either their use or storage position. With the cover in the closed position, the magazine and cover assembly acts as a handle for any selected tools secured in their use position.

16 Claims, 4 Drawing Sheets

SELF-STORING TOOL SET

BACKGROUND OF THE INVENTION

1. Field:

This invention relates to hand tools. It is directed to hand-held devices which store a plurality of working tools in a handle assembly, and more specifically to devices in which the working tools are pivotally connected to the handle assembly and are placed in a position of use by means of pivoting with respect to the assembly.

2. State of the Art:

There are a number of devices in which tools are held in a storage area within a handle, and in which the tools may be retrieved from the storage area and secured in a position of use with respect to the handle.

For example, in certain screwdrivers the tools are held within a rotating magazine within the handle. The magazine is rotated to place the selected tool in a position to slide into a chuck (a structure which operably secures the selected tool firmly fixed for use). Typical screwdrivers employing such rotating magazines are disclosed in U.S. Pat. Nos. 3,194,286 (Wagner); 3,753,455 (Butler); and 4,480,668 (Lin).

Alternatively, the tools may be held in longitudinal bores formed in the handle itself. A key structure is connected generally perpendicularly to each tool and extends to the outside of the handle. The key slides in longitudinal slots formed in the handle. The user pushes on the appropriate key to slide the selected tool into the chuck portion of the screwdriver. Typical screwdrivers employing such key and slot arrangements are disclosed in U.S. Pat. Nos. 1,225,922 and 3,750,729.

In other multiple-tool screwdrivers, the tools are held within an interior cavity in the handle. The rear of the handle is opened, a tool taken out of the interior cavity, and the tool manually placed in a chuck at the other end of the handle. A typical such screwdriver is disclosed in U.S. Pat. No. 1,555,109 (Eliason).

In other screwdrivers, the tools are pivotally connected to a sliding magazine. The magazine slides partially out of the handle to expose the tools, and a selected tool is pivoted outward for use. The magazine is then slid back into the handle, and the handle and the magazine act to secure the selected tool in a position for use. Typical screwdrivers employing such sliding magazines are disclosed in U.S. Pat. Nos. 537,246 (Stone) and 2,662,568 (Lavietes).

Also common are devices in which tools are mounted pivotally at either end of a handle. The tools are simply hinged outward for use. This simple pivoting structure is used in common pocketknives, and is also used for feeler gauges and hex-head keys.

SUMMARY OF THE INVENTION

A hand-held self-storing tool set of this invention comprises a multiplicity of tools pivotally connected by pivot means to a magazine. This magazine may be, for example, a drawer or a tray. A cover movably attaches to the magazine so that it can be opened or closed with respect to the magazine. With the cover open, tools may be selectively retrieved from the magazine and placed in a position for use. The cover may teen be closed to firmly secure a selected tool in position for use, and the tool set acts as an effective handle for the selected tool.

The tool set of this invention may have various exterior shapes and cross sections, depending upon factors such as ergonomic objectives and shape of tools. The tool set may also be made quite compact, having a length and/or cross sectional area only slightly greater than the sum total of the tools. In addition, a disconnectable pivot means may be employed so that the tools may be removed and interchanged with other tools. This interchangeability allows the user to select an appropriate kit of tools for a particular intended use.

A suitable tray may be fashioned to contain a set of tools, the tray having a bottom member and two upright sidewalls. A plurality of tools are pivotally connected to the tray by means of an axle passing through cylindrical bores formed in shanks at one end of each of the tools and the axle engaging the opposite sidewalls of the tray. The tools are in their storage positions when they are atop the bottom member and within the sidewalls of the tray. The tools may be placed in their use position by the shanks being pivoted 180° from their storage positions.

A cover is connected to the tray, the cover having an open and a closed position. In the preferred embodiment, the cover and tray are slidably connected. The cover is opened or closed by sliding the cover with respect to the tray. However, the drawer and cover may optionally be pivotally connected with the pivoting axis of the cover being formed at the end of the tray opposite from where the tools are connected and the cover opened or closed by pivoting the cover up or down, respectively. With the cover open, the tools are exposed to view and may be pivoted between their use and storage positions. With the cover in its closed position, the shanks of the tools are locked in place and tools are either secured in their use position or are contained within the cover. The tray and cover form a handle assembly by which a user may manipulate a selected tool.

This handle assembly is sturdy and rigid. The shanks of the tools adjoin each other, and the plurality of these shanks are held snugly between the sidewalls of the tray. The tray, cover, axle and shanks form a solid "chuck" for a selected tool in its use position. In addition, the handle assembly is adapted so that a user would naturally hold the handle assembly with his thumb and fingers close to the tool that is in use. This proximity of the fingers to the in use tool increases stability of the device.

In a highly preferred embodiment of this invention, the handle assembly has a relatively greater width than thickness. For example, the handle assembly may have the exterior shape of a rectangular box or an oval cylinder. Having one lateral dimension relatively greater than the other lateral dimension is ergonomically advantageous. The user naturally grasps the handle assembly in such a way that the shorter later dimension (thickness) is held in opposition between the thumb and index finger. One of the longer flatter sides of the handle rests against the fingers (primarily the index finger) with the thumb acting in opposition on the opposite side. This arrangement not only aids in precluding the handle from rotationally moving within the fingers, but increases the leverage that the fingers can exert upon the handle.

In embodiments having a relatively greater width than thickness, the axle is placed in the direction the width is measured. An advantage of placing the axle in the direction of the longer lateral dimension (the width) is that for a given cross-sectional area, the effect of the axle as a lever is maximized. Since the axle acts as a moment arm upon the tools when torsional force is applied, the longer the axle, the greater the leverage that can be applied. Also, a greater axle length increases the number of tools that can be placed in the drawer.

The handle assembly of this invention may also have a square or nearly square cross section. Square or nearly square cross section embodiments may be useful for tools that have a higher profile, such as open-end or box-end wrenches.

The handle assembly of the invention may have a uniform cross section throughout its length. The lack of extraneous knobs or handles increases lateral compactness, and also tends to minimize cost of manufacture and overall weight. Further compactness is achieved by making the tool set only slightly longer than the longest tool.

Embodiments having rectangular box shapes (square or oblong cross sections) are particularly adapted to be compact in cross-sectional area. Similar tools placed in a row along an axle tend to occupy a roughly rectangular cross-sectional area. Hence, a rectangular box containing such tools tends to make effective use of interior and exterior space. However, embodiments having non-rectangular cross sections may also be quite compact laterally if the cross section is adapted roughly to conform to tools of varying profiles. In other words, embodiments of the invention which are laterally compact may be formed by adapting the tool set to have a cross-sectional area only slightly greater than that of the tools.

In other embodiments of the invention a plurality of individual tool sets with rectangular cross sections may be assembled in a stacked arrangement with other similar tool sets. Effectively, a multiple-tray tool set may thus be fashioned.

The tool set of this invention may be embodied as a cylindrical box with a circular cross section. In contrast to the prior art screwdrivers that have sliding magazines, this embodiment has no extraneous knobs or handles. The tray and cover themselves constitute the handle, thusly avoiding the necessity for a separate knob or handle at the butt end of the magazine. The cross section is uniform throughout the length of the handle assembly, and the handle assembly is shaped so that the user naturally places his fingers near the axle, with the resultant increased stability characteristic of this invention. Other similar embodiments within this contemplation have cross sections that approach roundness, such as various polygonal shapes.

The tool set may be fashioned with tools pivotally mounted at both ends of the tray. The cover opens to expose tools by sliding the cover in either direction. Thus, tools may be placed in a use position at both ends of the tray at the same time. This arrangement may be of use in applications where two tools are intermittently needed, but where repeatedly opening and closing the cover is an inconvenience. For example, a user may conveniently use, in rapid succession, a phillips and a standard screwdriver, an open-end and a box-end wrench, or two sizes of hex-head keys.

The axle may be fashioned so that it is removable from the tray and the tools, enabling the user to interchange tools. A user may then select a kit of tools to adapt the tool set to a particular use, such as the repair of a particular type of appliance or adjustment of particular sporting equipment. The preferred embodiment of such a removable axle is a threaded shoulder bolt, although other structures, such as roll pins, are also useful.

A disengagable lock pin may be fashioned in the cover. A spring-loaded lock pin engages with a depression in the drawer so that the cover can be locked in its closed position. A button assembly associates with the lock pin so that when the button is depressed, the lock pin disengages with the drawer. This lock pin arrangement precludes the cover from sliding open while in use or while the tools are in storage.

DETAILED DESCRIPTION OF THE DRAWINGS

Figure 4:
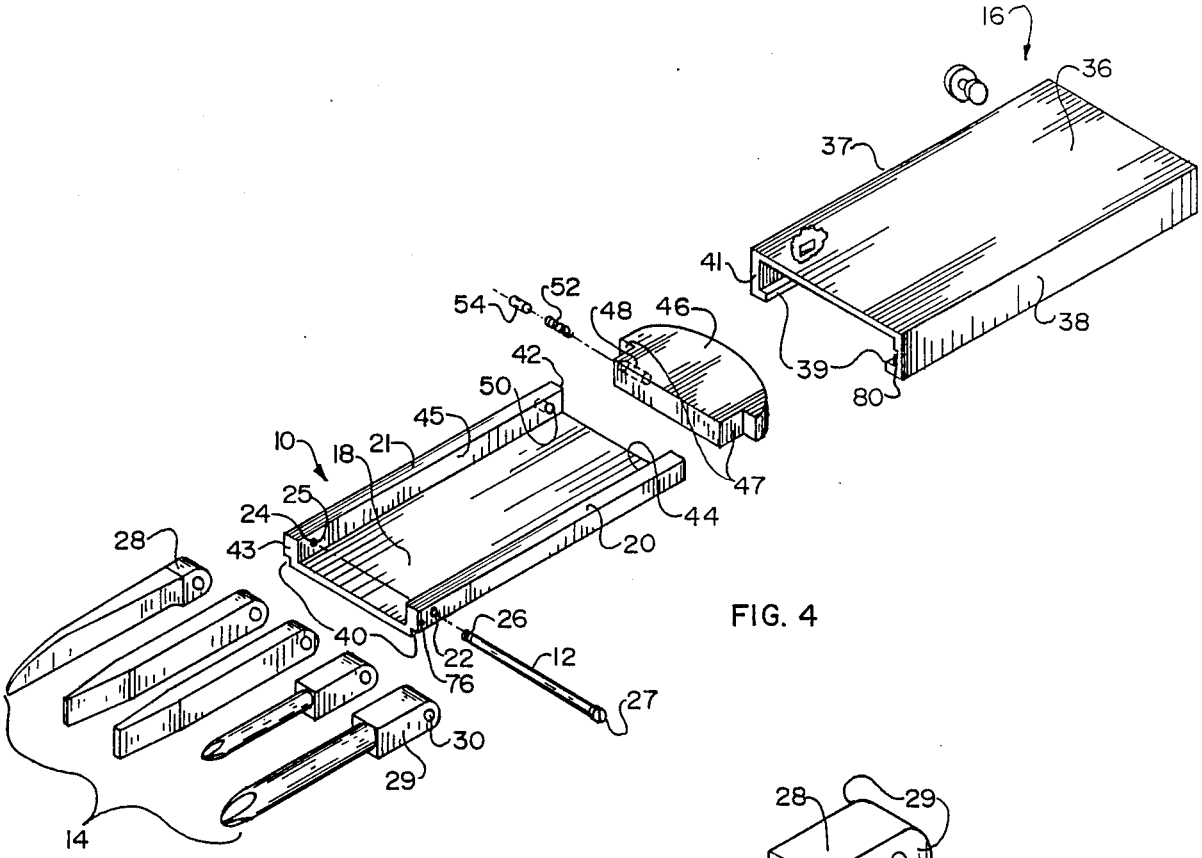
FIG. 4 is an exploded perspective view of the embodiment of FIG. 1.

The drawings depict various embodiments of the multiple tool device of this invention. As illustrated in FIG. 4, the device contains a tray 10, a shoulder bolt 12, a plurality of tools 14 and a cover 16.

A tray 10 includes a bottom panel member 18 and a pair of approximately parallel side members 20 and 21. A cylindrical bore 22 is provided in the side member 20. Another cylindrical bore 24 of smaller diameter with its central axis congruent with that of bore 22 is provided in side member 21. Bore 24 contains interior threads 25.

A cylindrical shoulder bolt 12 is adapted to pass snugly through the cylindrical bore 22. Exterior threads 26 carried by the bolt 12 engage with interior threads 25 of bore 24. The bolt 12 has a slotted head 27 adapted to receive a standard screwdriver to facilitate its installation or removal.

Figure 5:
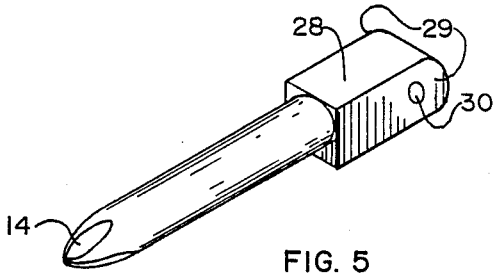
FIG. 5 is an enlarged view of a tool which is typical of the tools 14 of FIG. 4.

FIG. 5 is an enlarged view of a typical one of the plurality of tools 14 of FIG. 4. This view is not intended to be proportional to any one of the tools 14, but only illustrative as including elements of the plurality of the tools 14. The tools 14 are individually provided with shanks 28. The shanks 28 are collectively sized and adapted to fit snugly within the sides 20 and 21 of the tray. Each of the shanks 28 has sides 29 and a cylindrical bore 30. The bores 30 are in registration with each other, and are otherwise adapted snugly to receive the shoulder bolt 12. Thus, the tools may be individually pivoted upon the bolt 12, but are nevertheless held firmly without undue freedom of movement.

The tools 14 may rotate on the bolt between two positions. In their storage positions tools are placed along the bottom 18 and contained within the sides 20 and 21 of the tray. In their use position, the tools are rotated 180° from their storage positions.

The illustrated cover element 16 includes a top panel member 36 and a pair of approximately parallel depending side members 37 and 38. The distal edges of the side members present a pair of mutually opposed rails 39 approximately parallel each other. The rails 39 are adapted to register with the grooves 40 of the tray 10 so that the tray 10 and the cover 16 associate slidingly in relationship to each other.

Figure 1:
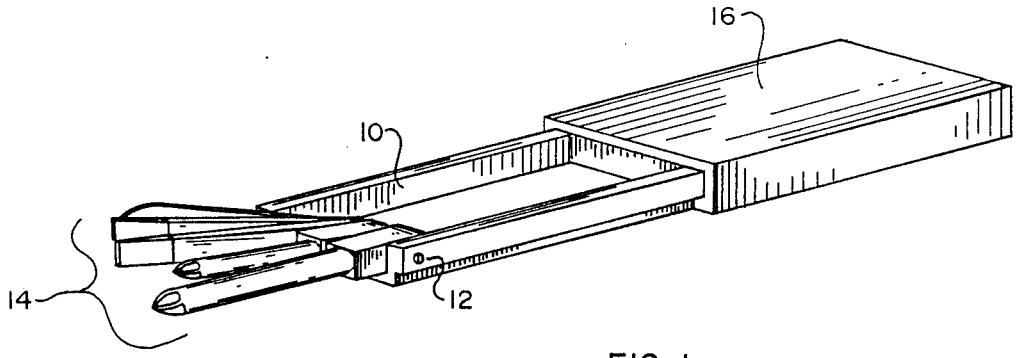
FIG. 1 is a perspective view of one embodiment of the invention in open position.
Figure 2:
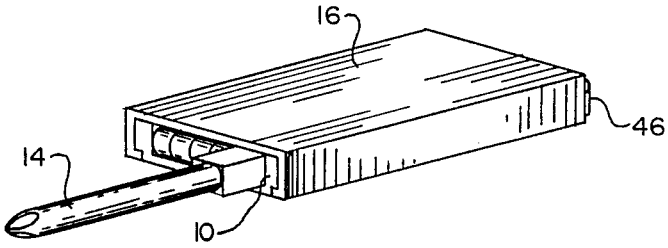
FIG. 2 is a perspective view of the embodiment of FIG. 1 in closed position with a tool pivoted from storage to its normal position of use.
Figure 3:
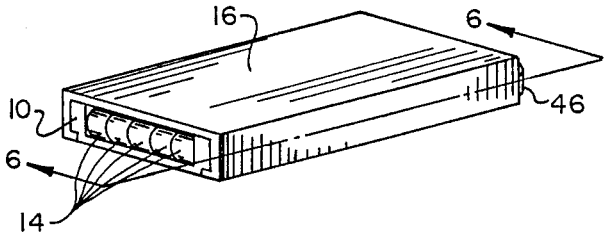
FIG. 3 is a perspective view of the embodiment of FIG. 1 in closed position with all of the tools stored for storage or transport.

With this sliding relationship between the tray 10 and the cover 16, the cover 16 may be placed in either an open position (FIG. 1) or a closed position (FIGS. 2 and 3). In the open position, the front face 41 of the cover 16 is slid toward the rear 42 of the tray 10 a sufficient distance to expose the tools to allow all of the tools to pivot between their use and storage positions. In its closed position, the front face 41 of the cover 16 is flush with the front face 43 of the tray 10.

The shanks 28 of the tools serve to add strength to the connection between the bolt 12 and any tools that may be in use. The sides 29 (FIG. 5) of the shanks of the tools present planar surfaces which are parallel to interior faces 44 and 45 of the sides 20 and 21 of the tray 10. The shanks 28 of the tools fit snugly within the sides 20 and 21. The association of the sides 29 and the faces 44 and 45 increase the surface area of the tool upon which the assembly exerts force upon the tool, thus increasing the overall strength of the connection between the assembly and the tool.

A plug 46 of width equal to the tray 10 and of thickness of the upright sides 20, 21 is attached to the rear end 42 of the tray 10. It is provided with notches 47 which register with the inside faces 44 and 45 of the upright sides 20, 21, as shown.

A cylindrical bore 48 in the plug associates and registers with the cylindrical bore 50 of equal diameter in the upright side 21. A spring 52 is placed in the cylindrical hole 48. A cylindrical lock pin 54 is placed on the spring in the cylindrical bore 48 so that the spring 52 biases the lock pin 54 outwardly into the bore 50.

Figure 6:
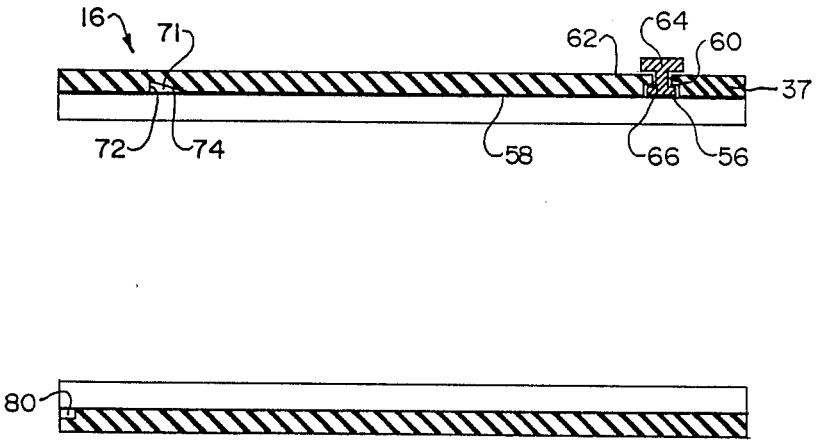
FIG. 6 is a cross-sectional view of the cover 16 of FIG. 3 taken along the line 6—6 of FIG. 3.

FIG. 6 is an expanded cross-sectional view of the cover 16 taken along line 6—6 of FIG. 3. A cylindrical bore 56 of diameter slightly larger than the lock pin 54 is provided in communication with the inside face 58 of side 37. This bore 56 is located so that when the cover 16 is in its closed position with respect to the tray 10, the lock pin 54 engages with the cylindrical bore 56.

Cylindrical bore 60 in the outside face 62 of side 37 is of smaller diameter than, and connects with, cylindrical bore 56. A button 64 is mounted within the bore 60 as shown. The button 64 is reciprocally mounted within the bore 60 and is of appropriate length to ensure that when the button 64 is pressed against the outer surface 62 of the cover 16, the inner surface 66 is brought approximately flush with the interior surface 58 of the side 37. When cover 16 is in its closed position in relation to the tray 10, the lock pin 54 engages with the cylindrical bore 56, and the cover 16 is thus locked in its closed position. When the button 64 is pressed inwardly toward the side 37, the lock pin 54 disengages from the bore 56, and the cover 16 may slide freely.

A beveled notch 71 is fashioned in the interior face 58 of the side 37. The notch 71 has a flat edge 72 parallel to the end 41 of the cover 16, and a sloped ramp 74 at an oblique angle to the interior face 58 of side 37. The notch 71 is located so that when the cover 16 is in its open position, the lock pin 54 will engage with the notch 71. The lock pin 54 abutting against the edge 72 stops the cover 16 from traveling past its open position as it travels from its closed position. As the cover 16 is moved from its open position toward its closed position, the lock pin 54 will travel against the ramped surface 74, causing the lock pin to disengage from the notch 71.

A small cylindrical knob 76 (FIG. 4) is attached to the outer face 78 of the side 20 of the drawer 10. The knob 76 is attached near the face 43 of the tray 10. A small semicylindrical notch 80 (FIG. 6) is fashioned in the exterior corner formed at the junction between the face 41 and interior surface 82 of the cover 16. The notch 80 is positioned and sized so as to snugly receive the knob 76, thereby stopping the cover 16 from traveling past its closed position when it is moved from its open position.

The tools 14 and shoulder bolt 12 are preferably made of hardened steel or brass if they are expected to be subjected to relatively large forces. For maximum durability, the cover 16 and tray 10 may also be made of hardened steel or brass. However, when weight is an important factor, the tray 10 and cover 16 may be made of a lighter metal, such as plastic or aluminum alloy. Because the drawer 10 connects directly to the shoulder bolt 12, the strength of the tray 10 is more important than that of the cover 16. Hence, it may be advantageous, for example, to mate an aluminum alloy tray with a hard plastic cover.

The plug 46 may be made of a lightweight material such as hard plastic, aluminum, or other inexpensive material. The lock pin 54 may be made of any available relatively durable material, such as steel, brass, aluminum, or even hard plastic. The spring 52 is preferably made of hardened steel.

Figure 7:
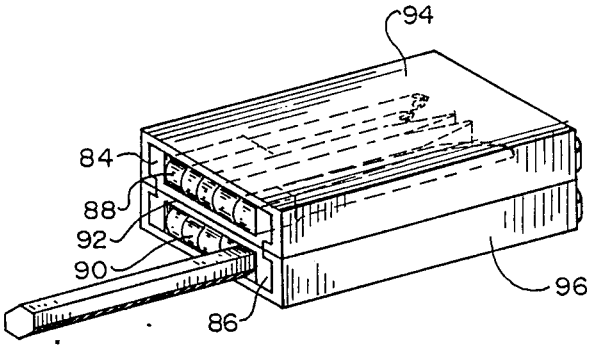
FIG. 7 is a perspective view of an alternative embodiment of the invention.

FIG. 7 illustrates two devices of the general type illustrated in FIGS. 1 through 5 joined in a single assembly with two tool trays 84 and 86 and two complete sets of tools 88 and 90. The trays 84 and 86 are connected at their bottom faces 92 so that either cover 94 and 96 may selectively and individually be placed in an open position. The tools of either drawer may be exposed for selection in this fashion. When both covers 94 and 96 are in their closed position, the entire assembly acts as a handle for any tool that may be in a use position.

Figure 8:
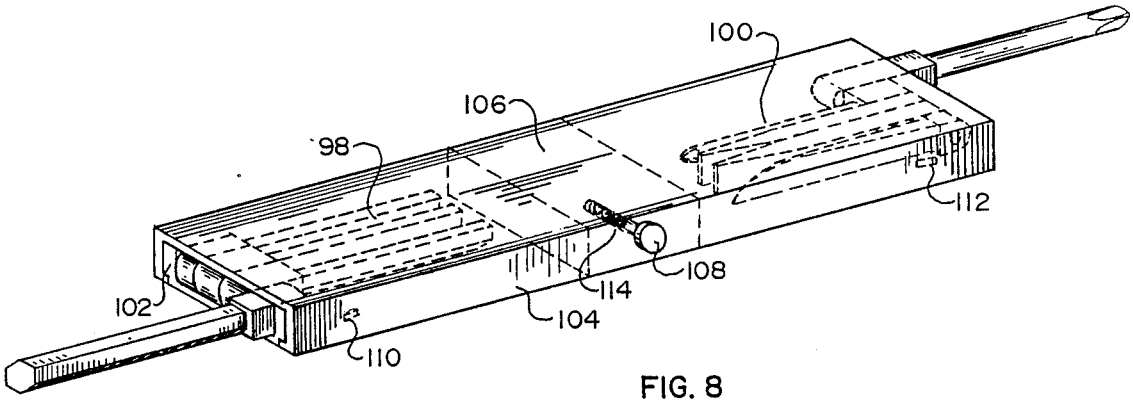
FIG. 8 is a perspective view of another alternative embodiment of the invention.

FIG. 8 illustrates a single assembly containing two complete sets of tools 98 and 100. Separate sets 98, 100 are pivotally mounted at opposite ends of a single tray 102. A single cover 104 is mounted to slidingly engage with the tray 102. A rectangular plug 106 is shown in the center of the tray. A lock pin and button assembly 108 (of the type illustrated by FIGS. 4 and 6, for example) is positioned in the center of this embodiment as shown. The cover in this assembly includes beveled notches 110 and 112 (of the type illustrated in FIG. 6, for example) at opposite ends of the cover which may associate with the lock pin 114 to preclude the cover from hyperextending in either direction in relationship to the drawer.

Figure 9:
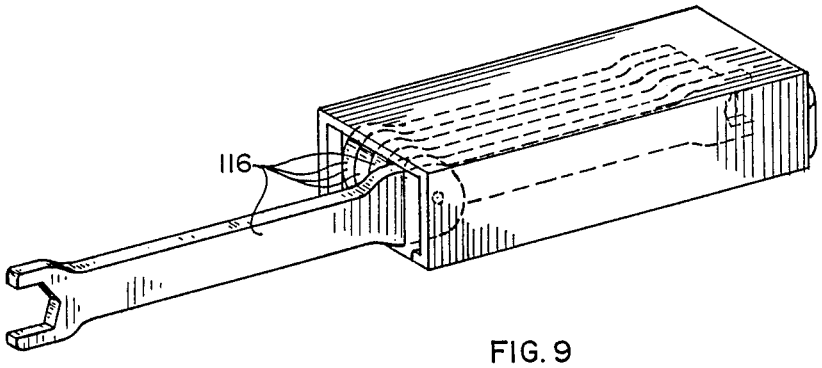
FIG. 9 is a perspective view of an embodiment of the invention having a thick cross section.

FIG. 9 illustrates an embodiment of the invention having a thick or nearly square cross section. In other words, the cross section of this embodiment is not relatively wide compared to its thickness. Tool sets of the invention within this contemplation may also have an exactly square cross section. This embodiment is adapted to accommodate a plurality of tools 116 having higher profiles, such as open end and box end wrenches.

Figure 10:
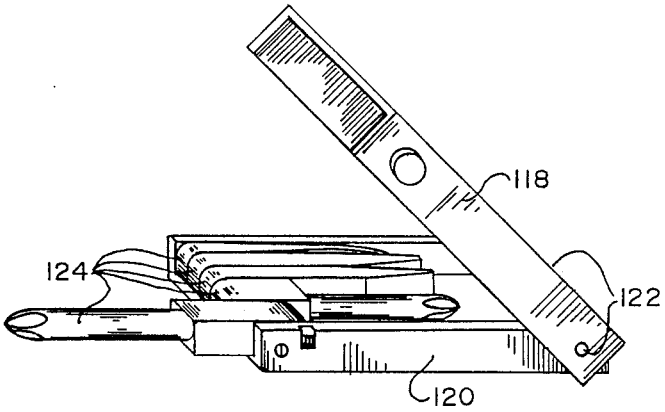
FIG. 10 is a perspective view of an embodiment of the invention in which the cover pivots with respect to the tray.

FIG. 10 is an embodiment of the invention in which the cover 118 pivotally connects to the tray 120 by means of rivets 122. The cover 118 is closed when it is generally parallel to the tray 120. The cover 118 is open when it is pivoted away from the tools 124 enough for a selected tool to be pivoted outward to its use position, as shown. When the cover 118 is closed, it acts similar to the embodiments previously illustrated to secure a selected tool in its use position or to secure all of the tools within the tool set.

Figure 12:
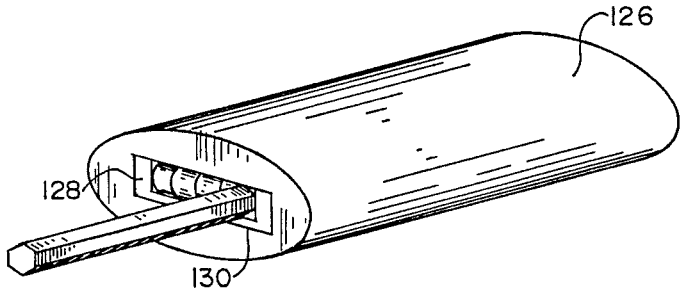
FIG. 12 is a perspective view of an embodiment of the invention having a rounded oval cross section.

FIG. 12 illustrates an embodiment of the invention in which the cover 126 has an elliptical cross section. As shown, the tray 128 of this embodiment does not have notches such as notches 40 of the tray 18 and typical of the other embodiments previously illustrated. Also, the bottom 130 of the embodiment is enclosed within the cover 126, as shown, as opposed to being exposed as in the other previously illustrated embodiments. The cover 126 of this embodiment may be preferably made of a lightweight material, such as plastic, ceramic or aluminum so as to minimize overall weight.

Figure 11:
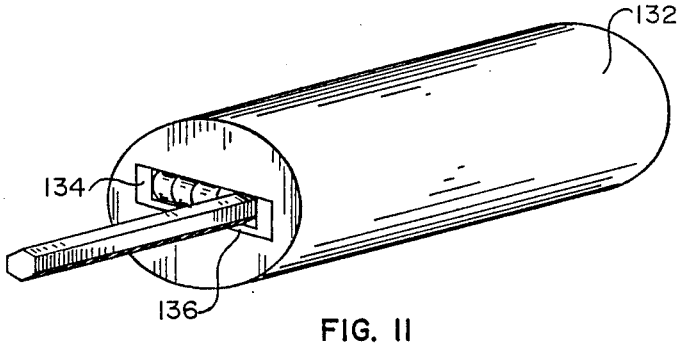
FIG. 11 is a perspective view of an embodiment of the invention having a circular cross section.

FIG. 11 illustrates an embodiment of the invention in which the cover 132 has a circular cross section. Similar to the embodiment of FIG. 12, the tray 134 of this embodiment does not have notches, and the bottom 136 of the tray 134 is enclosed within the cover 132, as shown. It may also be preferable in this embodiment to make the cover of a lightweight material such as hard plastic, ceramic, or aluminum to minimize the overall weight of the device.

Reference herein to details of the illustrated embodiment is not intended to limit the scope of the claims, which themselves recite those features regarded as important to the invention.

I claim:

1. A self-storing tool set, comprising:

a drawer with a bottom support and a pair of side supports upstanding from said bottom supports;

an axle connected between said side supports;

a plurality of elongated tools, mutually adapted and configured to rest in a stored position in side-by-side relation to each other atop said bottom support between said side supports, each said tool including a working end and a shank portion opposite said working end, said shank portions being pivotally mounted on said axle so that each tool may selectively be moved from its said stored position to a use position in which its working end extends beyond said drawer, and its shank portion is rotated approximately 180° with respect to its stored position;

a cover slidingly connected to said drawer for movement between a closed position in which it covers said drawer and an open position exposing said tools to view, thereby enabling the movement of a selected said tool between its stored and use positions;

guide means associated with said cover and said drawer for providing alignment and sliding engagement between said cover and said drawer; and stop means associated with said cover for precluding said cover from hyperextending beyond said open position as it moves from said closed position toward said open position;

said drawer, cover, and shanks being cooperatively adapted so that when said cover is in its closed position, said shanks are locked against pivoting movement so that said cover and drawer cooperatively form a rigid handle assembly sized and configured for grasping by the hand of an individual whereby forces may be exerted upon a tool in its use position with the fingers in close proximity of said axle.

2. A tool set according to claim 1 wherein said handle assembly has a cross section which is relatively wide compared to its thickness.

3. A tool set according to claim 1 wherein said axle extends through approximately cylindrical bores in said shank portions in snug-fit relation, and said plurality of shanks occupies substantially the entire distance between said side supports.

4. A tool set according to claim 1 including lock means to releasably hold said cover in its closed position.

5. A hand-held self-storing tool set comprising:

a drawer having a bottom support and two parallel upright side supports;

an axle interposed between and connected to said upright side supports;

a plurality of elongated tools, mutually adapted and configured to rest in a stored position in side-by-side relation to each other atop said bottom support between said side supports, each said tool including a working end and a shank portion opposite said working end, said shank portions being pivotally mounted on said axle so that each tool may selectively be moved from its said stored position to a use position in which its working end extends beyond said drawer and its shank portion is rotated approximately 180° with respect to its stored position; and a cover slidably connected to said drawer to slide between an open position and a closed position so that in its open position each of said tools may pivot between its use and stored position, so that in its closed position said tools are secured in either their use or storage position, said cover and drawer being mutually configured and adapted to provide alignment and sliding engagement between said cover and said drawer; and stop means associated with said cover for precluding said cover from hyperextending beyond said open position as it moves from said closed position toward said open position;

said drawer, cover, and shanks being cooperatively adapted so that when said cover is in its closed position, said shanks are locked against pivoting movement so that said cover and drawer cooperatively form a rigid handle assembly sized and configured for grasping by the hand of an individual whereby forces may be exerted upon a tool in its use position, the exterior of said handle assembly having a uniformly shaped cross section throughout its length.

6. A tool set according to claim 5, wherein said handle assembly has an oblong cross section having a relatively greater width than thickness.

7. A tool set according to claim 6, wherein said handle assembly has a rectangular cross section.

8. A tool set according to claim 5, wherein said handle assembly has a length and cross-sectional area only slightly greater than that of the sum total of said plurality of tools in their storage position.

9. A tool set according to claim 5, wherein said handle assembly has a rectangular cross section.

10. A tool set as recited in claim 9, wherein said handle assembly has a length and cross sectional area only slightly greater than that of the sum total of said plurality of tools in their storage position.

11. A tool set according to claim 5, wherein said handle assembly has a round cross section and a length only slightly greater than that of the longest of said tools.

12. A hand-held self-storing tool set, comprising:

a drawer having a rectangular bottom support, two parallel upright side supports, and two ends;

an axle interposed between and connected to said upright side supports, said axle being near one end of said drawer;

a plurality of elongated tools, mutually adapted and configurated to rest in a stored position in side-by-side relationship to each other atop said bottom support and between said side supports, each said tool having a working end and a shank portion opposite said working end, said axle extending through approximately cylindrical bores in said shank portions in a snug fit relation, said plurality of shanks occupying substantially the entire distance between said side supports so that each tool may selectively pivot from its said stored position to a use position in which its working end extends beyond said drawer and its shank portion is rotated approximately 180° with respect to its stored position;

a cover having a rectangular top and two parallel depending side members which slidingly engage with said drawer so that said cover is slidingly connected to said drawer for movement between a closed position in which it covers said tools and an open position exposing said tools to view, thereby enabling the movement of a selected tool between its stored and use position;

a rail and groove assembly associated with said drawer and said cover, said rail and groove assembly being adapted to provide for alignment and sliding engagement of said cover with said drawer; and stop means associated with said cover for precluding said cover from hyperextending beyond said open position as it moves from said closed position toward said open position;

said drawer, and shanks being cooperatively adapted to that when said cover is in its closed position, said shanks are locked against movement so that said cover and drawer cooperatively form a rigid handle assembly sized and configured for grasping by the hand of an individual whereby forces may be exerted upon a tool in its use position, said handle assembly having a rectangular cross section with a relatively greater width than thickness and a length and cross-sectional area only slightly greater than the plurality of said tools in their storage position.

13. A tool set according to claim 12, wherein said axle is removable from said drawer and said tools so that said tools may be removed and interchanged with other selected tools.

14. A tool set according to claim 12, including lock means to releasably hold said cover in its closed position.

15. A tool set according to claim 14 wherein said parallel depending side members of said cover engage with said parallel upright side supports of said drawer and wherein a bottom surface of said bottom support of said drawer is out of sliding engagement with said cover.

16. A tool set according to claim 15 wherein said rail and groove assembly comprises a pair of parallel rails associated with said parallel depending side members, and a pair of grooves formed in said drawer, said rails being in sliding engagement with said grooves.

* * * * *